US008911036B2

(12) United States Patent
Elkasevic et al.

(10) Patent No.: US 8,911,036 B2
(45) Date of Patent: Dec. 16, 2014

(54) DOMESTIC APPLIANCE HINGE ASSEMBLY WITH HINGE KEEPER

(75) Inventors: Suad Elkasevic, Winterville, NC (US); George May, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 244 days.

(21) Appl. No.: 13/472,522

(22) Filed: May 16, 2012

(65) Prior Publication Data

US 2013/0307392 A1 Nov. 21, 2013

(51) Int. Cl.
*A47B 88/00* (2006.01)

(52) U.S. Cl.
USPC ..... 312/328

(58) Field of Classification Search
CPC ..... E05F 1/1261
USPC ..... 312/325–329
See application file for complete search history.

(56) References Cited

U.S. PATENT DOCUMENTS

| | | | | |
|---|---|---|---|---|
| 3,299,879 | A * | 1/1967 | Doner | 126/194 |
| 6,719,383 | B2 | 4/2004 | Elick et al. | |
| 6,789,293 | B2 * | 9/2004 | Habegger et al. | 16/343 |
| 7,275,283 | B2 * | 10/2007 | Kistner et al. | 16/286 |
| 7,676,888 | B2 | 3/2010 | Vanini | |
| 2008/0168618 | A1 | 7/2008 | Hottmann | |
| 2008/0295283 | A1 | 12/2008 | Tice | |
| 2010/0018240 | A1 | 1/2010 | Hecht et al. | |
| 2010/0051067 | A1 | 3/2010 | Dalsing | |
| 2010/0109497 | A1 | 5/2010 | Blersch et al. | |
| 2010/0127606 | A1 | 5/2010 | Collene et al. | |
| 2010/0139169 | A1 | 6/2010 | Patil et al. | |
| 2010/0148646 | A1 | 6/2010 | Bettinzoli | |
| 2010/0281650 | A1 | 11/2010 | Kleemann et al. | |
| 2011/0017191 | A1 * | 1/2011 | White et al. | 126/198 |
| 2011/0068671 | A1 | 3/2011 | Vanini | |
| 2013/0291853 | A1 * | 11/2013 | Braden et al. | 126/19 R |
| 2013/0300273 | A1 * | 11/2013 | Elkasevic et al. | 312/327 |
| 2013/0300274 | A1 * | 11/2013 | Elkasevic et al. | 312/327 |
| 2013/0312219 | A1 * | 11/2013 | Elkasevic | 16/327 |
| 2013/0312220 | A1 * | 11/2013 | Elkasevic | 16/327 |
| 2013/0312222 | A1 * | 11/2013 | Elkasevic et al. | 16/327 |

* cited by examiner

*Primary Examiner* — Darnell Jayne
*Assistant Examiner* — Timothy M Ayres
(74) *Attorney, Agent, or Firm* — James E. Howard; Andre Pallapies

(57) ABSTRACT

A hinge assembly is provided for pivotably attaching a door to a domestic appliance. The hinge assembly has a hinge body that attaches to the door; a damper including a damper cylinder attached to the hinge body; a foot attached to the hinge body and the cylinder and engaging a foot receiving portion of the domestic appliance; and a hinge keeper fixedly attached to the appliance body of the domestic appliance. The hinge keeper has a retaining portion that contacts the foot, the retaining portion having an edge that contacts the foot from above such that the foot is prevented from moving vertically upward relative to the appliance body of the domestic appliance, and a fixing portion fixed to the appliance body of the domestic appliance and preventing the retaining portion from moving vertically upward relative to the appliance body of the domestic appliance.

14 Claims, 4 Drawing Sheets

DOMESTIC APPLIANCE HINGE ASSEMBLY WITH HINGE KEEPER

FIELD OF THE INVENTION

The invention is directed to a hinge assembly for a domestic appliance. The hinge assembly has a hinge keeper that keeps the hinge securely positioned relative to the domestic appliance.

An example of an application for the invention is a hinge assembly used with a door of a domestic appliance.

BACKGROUND OF THE INVENTION

Many domestic appliances, such as built in ovens, have one or more doors that swing open about a horizontal axis such that the door swings downward into an open position. Such a door is often heavy and uses springs of significant strength to counteract a portion of the weight of the door so that it is easier for a user to open and close the door. These springs often act to slam the door into the closed position after the door has passed a particular rotational position when moved upward toward the closed position. This slamming is undesirable for at least the reasons that it can make a loud noise, it can damage the appliance over time, and it gives the appearance of low quality. The result of such slamming is usually that the user continues to hold the door unit it has reached the closed position.

To prevent the undesirable slamming, soft-close hinges can be employed. Soft-close hinges often include some type of damper that slows the movement of the door for a predetermined distance before the door reaches the closed position. This damping prevents the slamming of the door and results in a much more desirable appliance.

SUMMARY

Some dampers include a spring mounted inside a cylinder. The spring is often very long compared to its diameter in order to fit inside the cylinder. The damper can include a rod that moves relative to the cylinder when the damper is operated. A hinge assembly can include a damper, a spring, a hinge body, and a hinge foot. Often a domestic appliance, an oven for example, is provided with one hinge assembly on each side of an opening which is covered by the door. The hinge foot can be provided with an engagement portion that engages a foot receiving portion on the body of the domestic appliance. Due to the spring and damper forces acting on the foot and the foot receiving portion, the foot can have a tendency to move relative to the foot receiving portion at certain points along the motion between the open and closed positions. This is particularly true at or near the ends of the opening and closing motions. These forces can be caused by the spring and damper acting on the linkage that attaches the foot to the cylinder.

The above movement can result in the door moving out of alignment with the body of the domestic appliance. This misalignment can result in the top of the door contacting other parts of the domestic appliance such as, for example, a control panel located above the door. Such contact is undesirable for at least the reasons that it can cause damage to the door and/or the control panel, and it makes the domestic appliance appear to be of poor quality.

The invention recognizes the existence of the above described movement of the foot and that it can be caused by the spring and damper acting on the linkage that attaches the foot to the cylinder. To address this problem, the invention provides a hinge keeper that holds the foot in the proper position relative to the domestic appliance body, but simultaneously allows the required movement of the hinge assembly.

Particular embodiments of the invention are directed to a hinge assembly for pivotably attaching a door to a domestic appliance having an appliance body. The hinge assembly includes a hinge body configured to attach to the door such that the hinge body is fixed relative to the door; a damper including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder; a foot attached to the hinge body and the cylinder, the foot being configured to engage a foot receiving portion of the domestic appliance such that the hinge body and the door pivot relative to the domestic appliance; and a hinge keeper configured to be fixedly attached to the appliance body of the domestic appliance. The hinge keeper has a retaining portion that contacts the foot, the retaining portion having an edge that contacts the foot from above such that the foot is prevented from moving vertically upward relative to the appliance body of the domestic appliance, and a fixing portion that is adapted to be fixed to the appliance body of the domestic appliance and prevent the retaining portion from moving vertically upward relative to the appliance body of the domestic appliance.

Other embodiments of the invention are directed to an assembly for pivotably attaching to a domestic appliance having an appliance body. The door assembly includes a door; and a hinge assembly for pivotably attaching the door to the appliance body of the domestic appliance. The hinge assembly includes a hinge body attached to the door such that the hinge body is fixed relative to the door; a damper including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder; a foot attached to the hinge body and the cylinder, the foot being configured to engage a foot receiving portion of the domestic appliance such that the hinge body and the door pivot relative to the domestic appliance; and a hinge keeper configured to be fixedly attached to the appliance body of the domestic appliance. The hinge keeper has a retaining portion that contacts the foot, the retaining portion having an edge that contacts the foot from above such that the foot is prevented from moving vertically upward relative to the appliance body of the domestic appliance, and a fixing portion that is adapted to be fixed to the appliance body of the domestic appliance and prevent the retaining portion from moving vertically upward relative to the appliance body of the domestic appliance.

Other embodiments of the invention are directed to a domestic appliance having an appliance body with a foot receiving portion; a door; and a hinge assembly pivotably attaching the door to the appliance body of the domestic appliance. The hinge assembly includes a hinge body attached to the door such that the hinge body is fixed relative to the door; a damper including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder; a foot attached to the hinge body and the cylinder, the foot engaging a foot receiving portion of the domestic appliance such that the hinge body and the door pivot relative to the domestic appliance; and a hinge keeper fixedly attached to the appliance body of the domestic appliance. The hinge keeper has a retaining portion that contacts the foot, the retaining portion having an edge that contacts the foot from above such that the foot is prevented from moving vertically upward relative to the appliance body of the domestic appliance, and a fixing portion that is fixed to the appliance body of the domestic appliance and prevents the retaining portion from moving vertically upward relative to the appliance body of the domestic appliance.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

Many domestic appliances, such as, for example, built-in ovens, have a door that pivots relative to the body of the appliance to permit access to an internal space of the appliance. These doors are often heavy due to glass view panels, insulation, ventilating structure, and other elements. Springs are often used to reduce the effort needed from the user to close the door. These springs can be strong in order to exert a force that counteracts a large portion of the weight of a heavy door. The result of strong springs is often a slamming of the door once the door passes a particular point in the pivoting.

One or more dampers can be used to damp the closing action resulting from the strong springs to eliminate the slamming that can be caused by undamped springs. The dampers can be any type of damper including, but not limited to, gas filled or liquid filled dampers. Examples of fluid (gas and/or liquid) filled dampers have a cylinder that contains the fluid and may or may not include one or more orifices through with the fluid moves to create the damping force.

Some door hinge assemblies include both a spring and a damper. Some of these door hinge assemblies place the spring inside the damper cylinder to provide a compact assembly.

Figure 1:
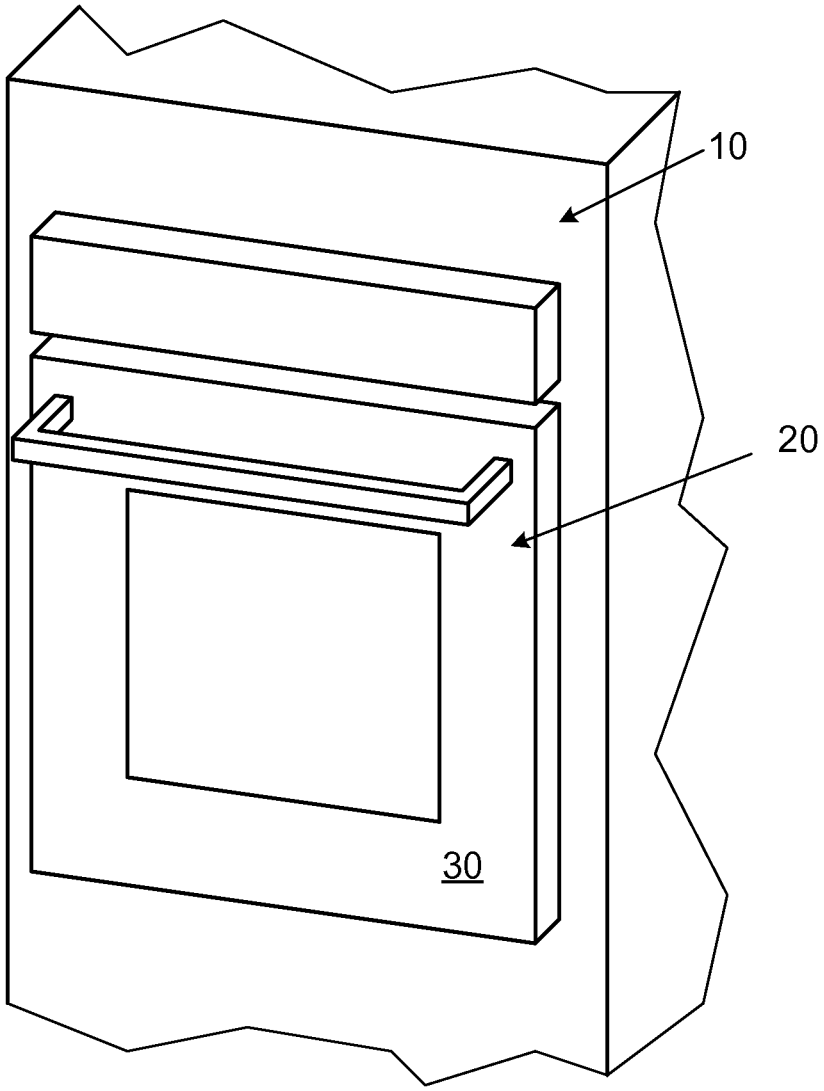
FIG. 1 is a perspective view of a domestic appliance in accordance with exemplary embodiments of the invention.

FIG. 1 shows an example of a domestic appliance 20 mounted in a cabinet 10. An example of a domestic appliance 20 is a cabinet-mounted oven. In this example, domestic appliance 20 includes a door 30 pivotably attached to a body of domestic appliance 20 to selectively open and close an interior space of domestic appliance 20. In some embodiments, door 30 is attached to the body of domestic appliance 20 by two hinge assemblies. Examples of the hinge assemblies are discussed below.

Figure 2:
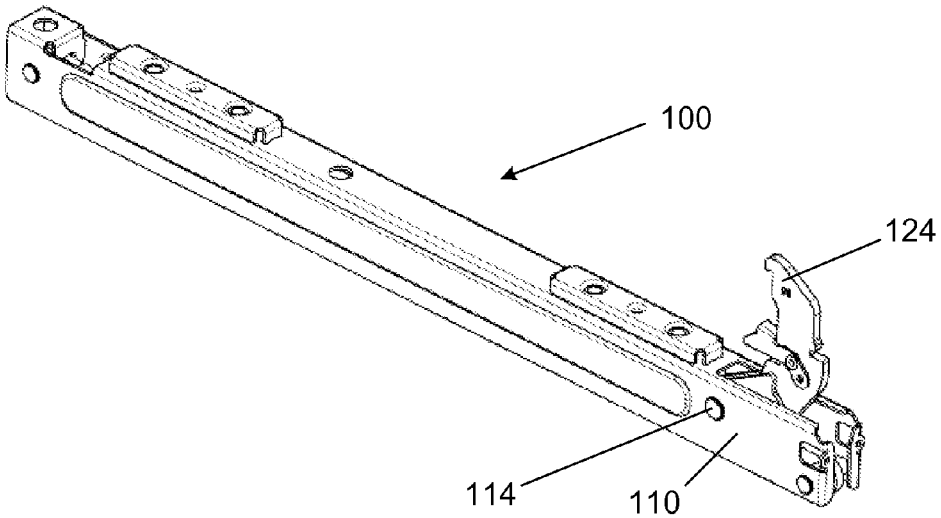
FIG. 2 is a perspective view of a hinge assembly in accordance with exemplary embodiments of the invention.
Figure 3:
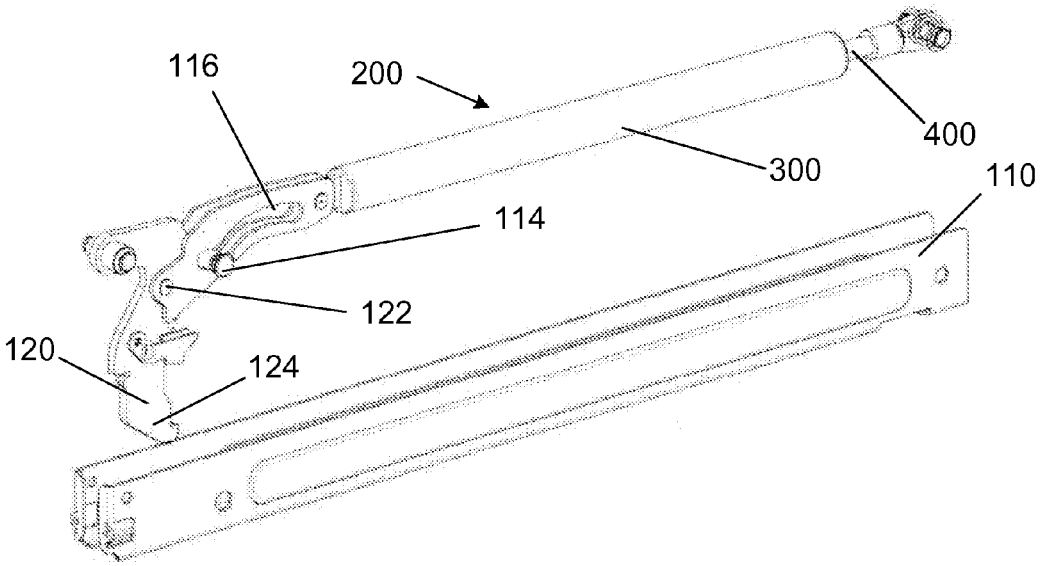
FIG. 3 is a partial exploded view of the hinge assembly shown in FIG. 2.

FIG. 2 shows a perspective view of a hinge assembly 100 that can be used to pivotably attach door 30 to the body of domestic appliance 20. In particular embodiments, two hinge assemblies 100 are used, one on each side of the opening of the interior space of domestic appliance 20. FIG. 3 shows hinge assembly 100 in a partially exploded view. A hinge assembly body 110 partially surrounds an assembly that includes a damper 200 and a foot 120.

Damper 200 includes a cylinder 300 and a rod 400. Rod 400 is partially inside cylinder 300 and partially outside cylinder 300 and moves in a reciprocating motion relative to cylinder 300. A damping force is applied to rod 400 as it moves relative to cylinder 300 and damps the motion of rod 400 relative to cylinder 300. This damping force can result from a fluid inside cylinder 300 being forced through at least one aperture when rod 400 moves, or from some other type of damping mechanism.

In this example, hinge assembly 100 is attached to door 30 such that hinge body 110 does not move relative to door 30. Also shown in FIGS. 2 and 3 is a foot 120 that is pivotably attached to damper 200 by a pin 122. An engagement end 124 of foot 120 in FIG. 3 engages a foot receiving feature (for example foot receiving portion 600 shown in FIG. 5) on domestic appliance 20 to attach door 30 to domestic appliance 20. Hinge assembly 100 and door 30 are then pivotable relative to the body of domestic appliance 20. Foot 120 is attached in this embodiment to the end of cylinder 300 such that foot 120 can pivot relative to cylinder 300.

Figure 4:
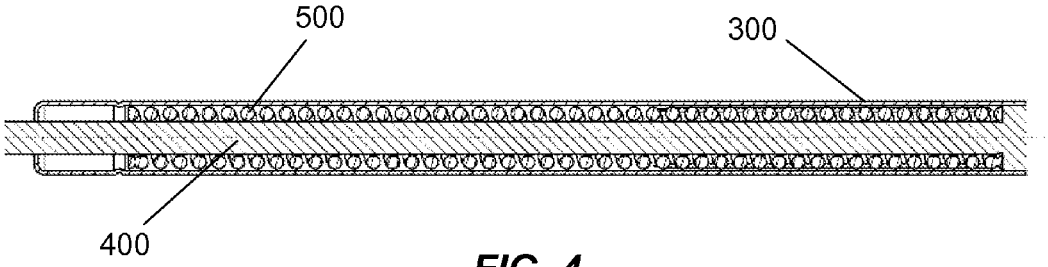
FIG. 4 is a sectional view of a damper in accordance with exemplary embodiments of the invention.

Embodiments of the invention include a coil spring positioned inside cylinder 300 as shown in FIG. 4. FIG. 4 shows rod 400 extending through the center of spring 500 and including a shoulder that supports the right side end of spring 500. As rod 400 is moved to the left in the figure, spring 500 is compressed. This movement corresponds to door 30 being moved from the closed position to the open position. As rod 400 is moved farther to the left, spring 500 becomes increasingly more compressed.

Figure 5:
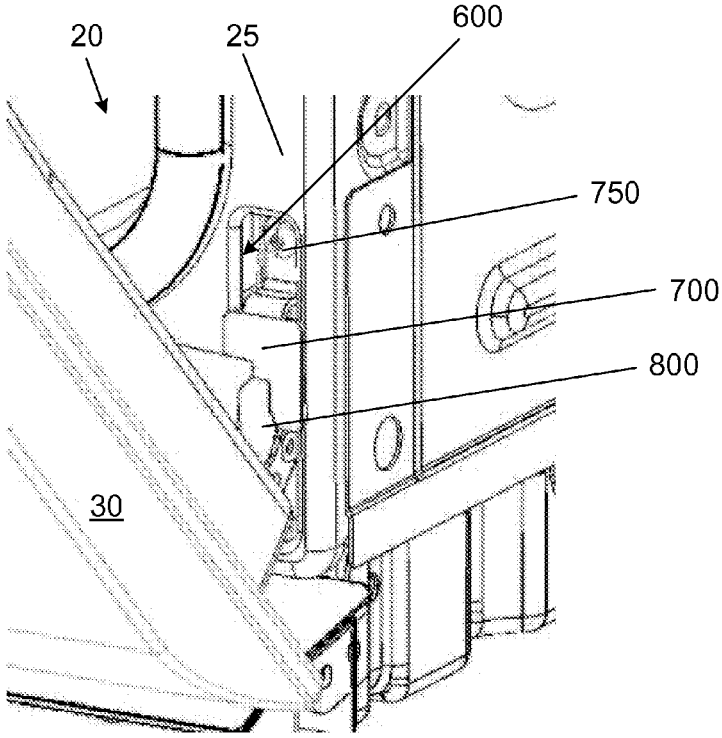
FIG. 5 is a perspective view of a hinge keeper in accordance with an exemplary embodiment of the invention in position on a domestic appliance body.
Figure 6:
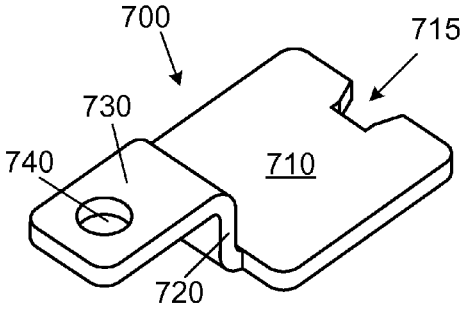
FIG. 6 is a perspective view of a hinge keeper in accordance with an exemplary embodiment of the invention.
Figure 7:
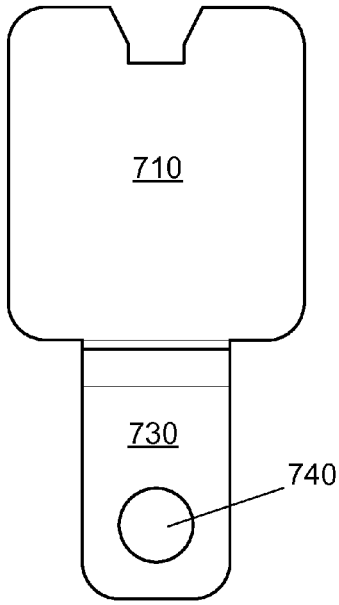
FIG. 7 is a top view of the embodiment shown in FIG. 6.
Figure 8:
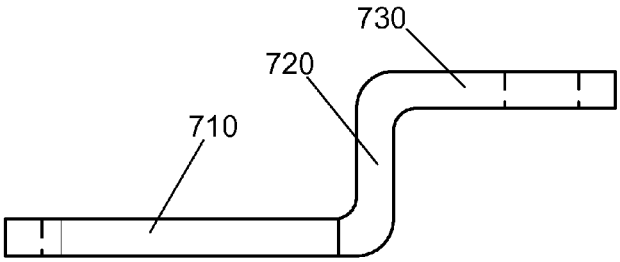
FIG. 8 is a side view of the embodiment shown in FIG. 6.
Figure 9:
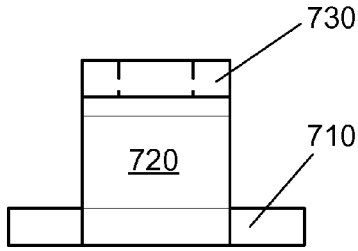
FIG. 9 is an end view of the embodiment shown in FIG. 6.

FIG. 5 shows door 30 attached to body 25 of domestic appliance 20, and in a partially opened position. Engagement end 124 of foot 120 is engaged with foot receiving portion 600 to keep door 30 attached to body 25.

In particular embodiments, foot 120 moves relative to door 30 in two ways (see FIG. 3). First, foot 120 moves relative to hinge body 110 by slot 116 sliding along pin 114 (which is fixed relative to hinge body 110). Second, foot 120 moves relative to cylinder 300 by foot 120 pivoting around pin 122. These movements cause pin 122 to follow a somewhat elliptical path that can tend to push foot 120 upward, thereby allowing door 30 to move upward in an undesirable way as described above. To prevent this undesirable movement of foot 120 (and thus door 30) relative to body 25, a hinge keeper 700 is provided.

FIGS. 6-9 show an example of a hinge keeper 700 that holds foot 120 in place and prevents the undesirable upward movement of foot 120. FIG. 5 shows hinge keeper 700 in place on body 25. As can be seen from FIGS. 6-9, hinge keeper 700 has a retaining portion 710 connected to a fixing portion 730 by an intermediate portion 720. As shown in FIG. 5, fixing portion 730 is fixed to body 25 by way of, in this example, a screw 750 passing through a hole 740 and threading into body 25. Although a screw is used in this example, other appropriate fasteners can be used. This example has a notch 715 in retaining portion 710. As shown in FIG. 5, notch 715 fits over a portion of a holding member 800 that is attached to body 25 so that holding member 800 helps prevent retaining portion 710 from moving away from body 25. As can be seen in FIG. 5, a bottom edge of retaining portion 710 prevents foot 120 from moving upward, thereby preventing the undesirable upward movement of door 30.

Although one particular embodiment of hinge keeper 700 is shown and described, other hinge keepers of other forms and shapes can also achieve the same result of preventing foot 120 from moving upward.

It is noted that in domestic appliances that have two hinge assemblies, particularly when the hinge assemblies are located or different sides of a door opening, slightly different spring characteristics, slightly different damper characteristics, and/or uneven wear of the spring, damper, or other components, can cause the hinge assemblies to operate with different force and damping characteristics. Such differences, can result in the door of the domestic appliance being twisted or skewed relative to the appliance body. Hinge keepers in accordance with the invention can prevent this twisting or skewing by holding the foot of each hinge assembly securing in place.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A hinge assembly for pivotably attaching a door to a domestic appliance having an appliance body, the hinge assembly comprising:

a hinge body configured to attach to the door such that the hinge body is fixed relative to the door;

a damper including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder;

a foot attached to the hinge body and the cylinder, the foot being configured to engage a foot receiving portion of the domestic appliance such that the hinge body and the door pivot relative to the domestic appliance; and a hinge keeper configured to be fixedly attached to the appliance body of the domestic appliance such that the hinge keeper is rotationally fixed relative to the appliance body, the hinge keeper having a retaining portion that contacts the foot, the retaining portion having an edge that contacts the foot from above such that the foot is prevented from moving vertically upward relative to the appliance body of the domestic appliance, and a fixing portion that is adapted to be fixed to the appliance body of the domestic appliance and prevent the retaining portion from moving vertically upward relative to the appliance body of the domestic appliance, wherein the retaining portion is planar and the fixing portion is planar, the retaining portion is parallel to the fixing portion, and the retaining portion and the fixing portion are not coplanar.

2. The assembly of claim 1, wherein the fixing portion comprises an aperture adapted to receive a fastener for fixing the fixing portion to the appliance body.

3. The assembly of claim 1, wherein the hinge keeper further comprises an intermediate portion, the intermediate portion connecting the retaining portion to the fixing portion.

4. The assembly of claim 3, wherein the intermediate portion is perpendicular to the retaining portion and the fixing portion.

5. The assembly of claim 1, wherein the retaining portion further comprises a notch in the edge, the notch receiving the foot such that the foot is restrained by the notch.

6. A door assembly for pivotably attaching to a domestic appliance having an appliance body, the door assembly comprising:

a door; and a hinge assembly for pivotably attaching the door to the appliance body of the domestic appliance, the hinge assembly comprising:

a hinge body attached to the door such that the hinge body is fixed relative to the door;

a damper including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder;

a foot attached to the hinge body and the cylinder, the foot being configured to engage a foot receiving portion of the domestic appliance such that the hinge body and the door pivot relative to the domestic appliance; and a hinge keeper configured to be fixedly attached to the appliance body of the domestic appliance such that the hinge keeper is rotationally fixed relative to the appliance body, the hinge keeper having a retaining portion that contacts the foot, the retaining portion having an edge that contacts the foot from above such that the foot is prevented from moving vertically upward relative to the appliance body of the domestic appliance, and a fixing portion that is adapted to be fixed to the appliance body of the domestic appliance and prevent the retaining portion from moving vertically upward relative to the appliance body of the domestic appliance, wherein the retaining portion is planar and the fixing portion is planar, the retaining portion is parallel to the fixing portion, and the retaining portion and the fixing portion are not coplanar.

7. The door assembly of claim 6, wherein the fixing portion comprises an aperture adapted to receive a fastener for fixing the fixing portion to the appliance body.

8. The door assembly of claim 6, wherein the hinge keeper further comprises an intermediate portion, the intermediate portion connecting the retaining portion to the fixing portion.

9. The door assembly of claim 8, wherein the intermediate portion is perpendicular to the retaining portion and the fixing portion.

10. The door assembly of claim 6, wherein the retaining portion further comprises a notch in the edge, the notch receiving the foot such that the foot is restrained by the notch.

11. A domestic appliance, comprising:

an appliance body having a foot receiving portion;

a door; and a hinge assembly pivotably attaching the door to the appliance body of the domestic appliance, the hinge assembly comprising:

a hinge body attached to the door such that the hinge body is fixed relative to the door;

a damper including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder;

a foot attached to the hinge body and the cylinder, the foot engaging a foot receiving portion of the domestic appliance such that the hinge body and the door pivot relative to the domestic appliance; and a hinge keeper fixedly attached to the appliance body of the domestic appliance such that the hinge keeper is rotationally fixed relative to the appliance body, the hinge keeper having a retaining portion that contacts the foot, the retaining portion having an edge that contacts the foot from above such that the foot is prevented from moving vertically upward relative to the appliance body of the domestic appliance, and a fixing portion that is fixed to the appliance body of the domestic appliance and prevents the retaining portion from moving vertically upward relative to the appliance body of the domestic appliance, wherein the retaining portion is planar and the fixing portion is planar, the retaining portion is parallel to the fixing portion, and the retaining portion and the fixing portion are not coplanar.

12. The domestic appliance of claim 11, wherein the fixing portion comprises an aperture that receives a fastener that fixes the fixing portion to the appliance body.

13. The domestic appliance of claim 11, wherein the hinge keeper further comprises an intermediate portion, the intermediate portion connecting the retaining portion to the fixing portion.

14. The domestic appliance of claim 11, wherein the retaining portion further comprises a notch in the edge, the notch receiving the foot such that the foot is restrained by the notch.

* * * * *